United States Patent [19]

Toda et al.

[11] 4,344,055

[45] Aug. 10, 1982

[54] AUTOMATIC TRIP DEVICE FOR CIRCUIT INTERRUPTER

[75] Inventors: Haruhisa Toda; Yoshiaki Matsumoto, both of Fukuyama, Japan

[73] Assignee: Mitsubishi Denki Kabushiki Kaisha, Tokyo, Japan

[21] Appl. No.: 143,206

[22] Filed: Apr. 24, 1980

[30] Foreign Application Priority Data

Apr. 24, 1979 [JP] Japan ..... 54-57272[U]

[51] Int. Cl.[3] ..... H01H 9/20

[52] U.S. Cl. ..... 335/174; 335/128; 335/276

[58] Field of Search ..... 335/174, 276, 128

[56] References Cited

U.S. PATENT DOCUMENTS 2,284,621 6/1942 Kuhn et al. ..... 335/276

3,296,564 1/1967 Cellerini ..... 335/35

*Primary Examiner*—Harold Broome

*Attorney, Agent, or Firm*—Robert E. Converse, Jr.

[57] ABSTRACT

An automatic trip device for a circuit breaker includes a U-shaped stationary iron core disposed around a current-carrying conductor. The stationary core includes a semicircular recess on one leg thereof having V-shaped bearing surfaces formed at each end of the recess. A movable iron core is positioned across the legs of the stationary core and includes semicircular projection fitted into the recess of the stationary core. A shaft extends through the projection and pivots at each end in one of the V-shaped bearing surfaces. Tension springs connected between the stationary core and one end of the movable core produce opening rotational bias on the movable core. Electromagnetic force produced by an over-current flow through the conductor causes closing rotational movement of the movable core. The disclosed construction results in elimination of undesireable sound vibrations produced in prior art devices under conditions of current flow below overload level.

6 Claims, 3 Drawing Figures

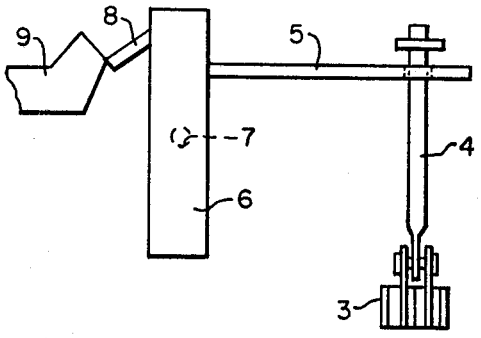
PRIOR ART
FIG. 1.
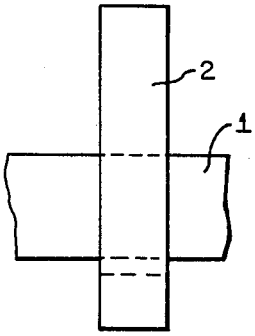

AUTOMATIC TRIP DEVICE FOR CIRCUIT INTERRUPTER

BACKGROUND OF THE INVENTION

Field of the Invention

The invention relates to an automatic trip device for a circuit breaker, and more particularly to an automatic trip device having a movable iron core and a stationary iron core surrounding a current carrying conductor.

SUMMARY OF THE INVENTION

A circuit breaker automatic trip device surrounding a current carrying conductor includes a stationary iron core, and a movable iron core having a shaft at a fulcrum of rotation. The stationary core has a V-shaped support portion formed thereon to pivotally support the shaft and the movable core.

BRIEF DESCRIPTION OF THE DRAWINGS

FIG. 1 is a partial side elevation of a circuit breaker including a prior art automatic trip device;

DESCRIPTION OF THE PREFERRED EMBODIMENT

Figure 2:
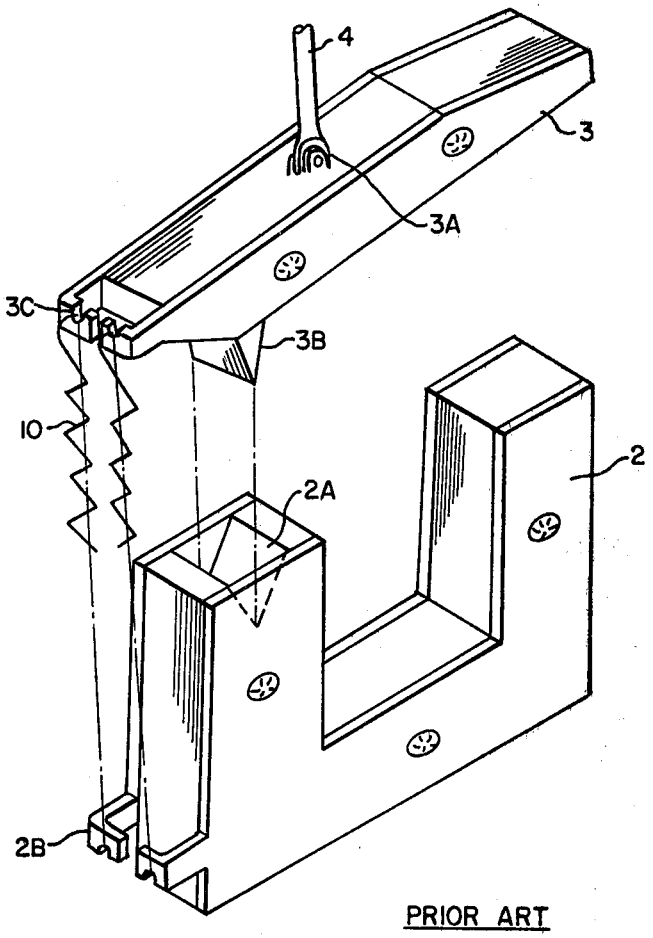
PRIOR ART FIG. 2.
FIG. 2 is an isometric view of the prior art automatic trip device of FIG. 1.

In the Figures, 1 is a conductor extending through the interior of a U-shaped stationary core of iron or other magnetic material, 2A is a supporting portion formed on one leg of the U-shaped stationary iron core 2, 2B is a first spring hook for engaging one of tension springs (which are described hereinafter), and 3 is a movable core of iron or other magnetic material which includes a protrusion 3A disposed on the central portion thereof. A triangular projection 3B is located opposite the supporting portion 2A on the stationary iron core 2 on the lefthand end of FIG. 2. Second spring hooks 3C for engaging the other of the tension springs are also provided.

A rod 4 is rotatably mounted at its one end to the protrusion 3A on the movable iron core and at its other end to a trip piece 5 described later. A trip piece 5 is mounted at one end to a trip rod 6 and is connected at its other end to the rod 4. A shaft 7 forms the center of rotation of the trip rod 6, and a locking member 8 is fixedly attached to the trip rod 6. A latch 9 is engaged by the locking member 8 and is connected to a switching mechanism (not shown) for a circuit interrupter. Tension springs 10 are engaged at both ends by the first spring hooks 2B on the stationary iron core 2 and the second spring hooks 3C on the movable iron core 3 to bias the movable iron core in a counterclockwise direction.

Upon occurrence of an overcurrent flowing through the conductor 1, a magnetic field is produced within the stationary iron core. The movable iron core 3 is rotated about the projection 3B supported by the supporting portion 2A on the stationary iron core 2 against the tension of the tension springs 10 by means of magnetic attractive force produced toward the stationary iron core 2. When the movable iron core 3 is rotated, the trip piece 5 rotates the trip rod 6 about the shaft 7 in a clockwise direction by means of the rod 4 rotatably mounted to the protrusion 3A on the movable iron core 3. Therefore, the locking member 8 disposed on the trip rod 6 and the engaging latch 9 are released from the engagement to interrupt a circuit through the switching mechanism (not shown) for the circuit interrupter interlocking with the latch 9.

Upon a flow of a current of not less than a predetermined magnitude, the movable iron core 3 is rotated in this way by means of the magnetic attraction of the stationary iron core 2, with the pivot point being formed by the surface of the portion 2A on the stationary iron core 2 supporting the surface of the triangular projection 3B on the movable iron core 3.

A disadvantage exists in that under certain conditions gaps may be formed between the contacting surfaces of the supporting portion 2A and the projection 3B due to factors such as machining dispersions. These gaps in combination with imbalance between the electromagnetic force imposed upon the movable iron core 3 and the spring force produced by the tension springs 10 may cause sound vibrations to be generated between the stationary and movable iron cores 2 and 3 respectively during conditions of current flow equal to or less than the predetermined magnitude.

An object of the present invention is to eliminate such disadvantages and to provide an electromagnetic device for a circuit interrupter in which sound vibrations are not generated.

Figure 3:
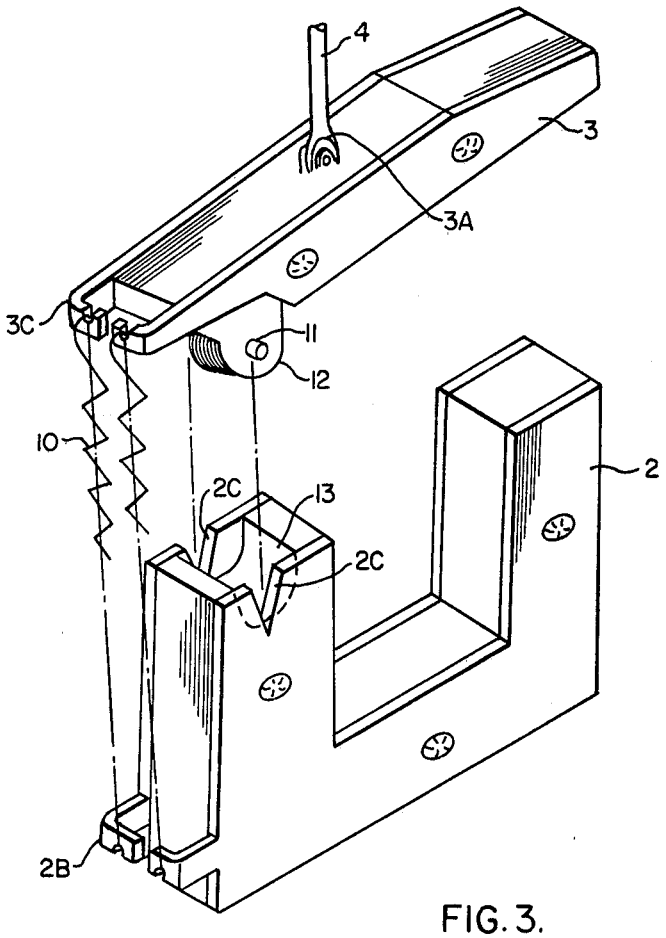
FIG. 3 is an isometric view of an automatic trip device incorporating the principles of the present invention.

Hereinafter one embodiment of the present invention is described in conjunction with FIG. 3. As shown in FIG. 3 a supporting portion 2C is provided on the stationary iron core 2 which includes two recessed V-shaped bearing surfaces on both ends thereof. Means for rotatably supporting the movable core 3 such as a shaft 11 is also provided on a substantially semicircular projection 12 fitted into a semicircular recess 13 and is supported at both sides of the projection 12 by the two V-shaped bearing surfaces of the supporting portion 2C. Other structural components are identical to the prior art and description thereof is omitted.

Since the supporting portion on the stationary iron core 2 is formed into V-shapes at two places, the shaft 11 of the movable iron core 3 is always supported by the two V-shapes when the movable iron core 3 is assembled on the stationary iron core 2.

According to the present invention, the shaft of the movable iron core is always supported in this way by the supporting portion on the stationary iron core without a gap. The resulting effect is the elimination of sound vibrations such as are generated by devices of the prior art.

What we claim is:

1. Circuit breaker automatic trip apparatus of the type adapted to enclose a current carrying conductor and operatively connect to a releasable circuit breaker switching mechanism, comprising:

a stationary core of magnetic material disposed about an associated current-carrying conductor, said stationary core comprising a pair of recessed bearing surfaces and means defining a recess between said bearing surfaces;

a movable core of magnetic material comprising a projecting member, rotatable support means, and means adapted for connection to an associated circuit breaker switching mechanism, said rotatable support means being supported by said recessed bearing surfaces and rotatably positioning said movable core such that said projecting member cooperates with said recess to complete a magnetic circuit with said stationary core, said movable core being rotatable between first and second positions, rotation to said second position being operable to actuate an associated circuit breaker switching mechanism; and means biasing said moveable core toward said first position.

2. Apparatus as recited in claim 1 wherein said rotatable support means comprises a pair of cylindrical extending members coaxial with the axis of rotation of said movable core, one of said extending members being supported in each of said bearing surfaces.

3. Apparatus as recited in claim 2 wherein said rotatable support means comprises a shaft extending through said movable core.

4. Apparatus as recited in claim 1 wherein said rotatable support means is located between said bias means and said connection means.

5. Apparatus as recited in claim 1 wherein said stationary core is U-shaped.

6. Apparatus as recited in claim 1 wherein said projecting member and said stationary core recess are semicircular in cross section, and said bearing surfaces comprise a pair of members having V-shaped indentations located on either side of said semicircular recess.

* * * * *